US005575005A

United States Patent [19]

Walker et al.

[11] Patent Number: 5,575,005

[45] Date of Patent: Nov. 19, 1996

[54] BASEBALL OR SOFTBALL GLOVE HAVING ELASTIC LINER

[75] Inventors: Alan D. Walker, Somers, Conn.; Andrew Jones, Roslindale, Mass.

[73] Assignee: Lisco, Inc., Tampa, Fla.

[21] Appl. No.: 383,461

[22] Filed: Feb. 3, 1995

[51] Int. Cl.[6] ..... A41D 13/08

[52] U.S. Cl. ..... 2/19; 2/161.1; 2/164

[58] Field of Search ..... 2/16, 18, 19, 20, 2/159, 160, 161.1, 161.5, 164, 161.2

[56] References Cited

U.S. PATENT DOCUMENTS

| | | | |
|---|---|---|---|
| Re. 28,036 | 6/1974 | Rosenbaum | 2/19 |
| D. 240,672 | 7/1976 | McTear | D2/361 |
| D. 242,298 | 11/1976 | McTear | D2/361 |
| D. 256,519 | 8/1980 | Hirsch | D2/361 |
| 272,945 | 2/1883 | Chambers . | |
| 368,724 | 8/1887 | Loucks | 2/19 |
| 600,779 | 3/1898 | Frazier | 2/18 |
| 1,276,099 | 8/1918 | Morrell . | |
| 1,377,648 | 5/1921 | Whitaker . | |
| 1,456,580 | 5/1923 | Sullivan . | |
| 1,490,174 | 4/1924 | Kennedy . | |
| 1,624,696 | 4/1927 | Turner . | |
| 1,631,735 | 6/1927 | Kennedy et al. . | |
| 1,900,395 | 3/1933 | Gitt . | |
| 2,056,326 | 10/1936 | Orsini | 2/18 |
| 2,092,574 | 9/1937 | Eddy | 88/80 |
| 2,295,507 | 9/1942 | Wells, Jr. et al. | 2/161 |
| 2,309,516 | 1/1943 | Lindfelt | 2/159 |
| 2,352,482 | 7/1943 | Curran | 2/159 |
| 2,976,540 | 3/1961 | Sutherland | 2/161 |
| 2,988,744 | 6/1961 | Stobbe | 2/19 |
| 3,119,118 | 1/1964 | Beebe | 2/162 |
| 3,504,379 | 4/1970 | Glick | 2/161 |
| 3,528,107 | 9/1970 | Rosenbaum | 2/19 |
| 3,588,917 | 6/1971 | Antonious | 2/161 |
| 3,918,097 | 11/1975 | Mlodoch | 2/161 |
| 4,042,977 | 8/1977 | Antonious | 2/161 A |
| 4,065,813 | 1/1978 | Hudson | 2/19 |
| 4,168,813 | 9/1979 | Rowland | 273/54 B |
| 4,197,592 | 5/1980 | Klein | 2/164 |
| 4,281,647 | 8/1981 | Antypas | 128/77 |
| 4,420,843 | 12/1983 | Genzling et al. | 2/164 |
| 4,471,495 | 9/1984 | Kruse et al. | 2/162 |
| 4,519,097 | 5/1985 | Chappell, Jr. et al. | 2/16 |
| 4,527,287 | 7/1985 | Aoki | 2/19 |
| 4,541,126 | 9/1985 | Howard et al. | 2/19 |
| 4,658,445 | 4/1987 | Tribble | 2/161 A |
| 4,665,561 | 5/1987 | Aoki | 2/19 |
| 4,700,405 | 10/1987 | Sternberg | 2/19 |
| 4,720,875 | 1/1988 | Latina et al. | 2/19 |
| 4,730,354 | 3/1988 | Saito | 2/161 A |

(List continued on next page.)

FOREIGN PATENT DOCUMENTS

| | | |
|---|---|---|
| 2638615 | 11/1988 | France . |
| 34035 | 8/1905 | Switzerland . |
| 4248 | 3/1983 | United Kingdom . |
| WO90/09115 | 8/1990 | WIPO . |
| WO92/08379 | 5/1992 | WIPO . |
| WO92/11780 | 7/1992 | WIPO . |
| WO93/11677 | 6/1993 | WIPO . |

*Primary Examiner*—C. D. Crowder
*Assistant Examiner*—Larry D. Worrell, Jr.

[57] ABSTRACT

Disclosed herein is ball-catching glove having a front portion and a back portion defining a hand space therebetween, an opening at an edge of the glove which is configured for passage of the hand of the wearer into the hand space, and an elastic liner formed in the hand space and connected to the front portion. The liner is configured to draw the wearer's hand toward the front portion, thereby providing for improved control by the wearer in opening and closing the glove.

19 Claims, 6 Drawing Sheets

U.S. PATENT DOCUMENTS

| | | | |
|---|---|---|---|
| 4,733,412 | 3/1988 | Campbell | 2/164 |
| 4,796,306 | 1/1989 | Mitchell | 2/160 |
| 4,853,975 | 8/1989 | Clevenhagen | 2/19 |
| 4,876,747 | 10/1989 | Coffey et al. | 2/168 |
| 4,884,300 | 12/1989 | Vistins | 2/162 |
| 4,928,320 | 5/1990 | Aoki | 2/19 |
| 4,937,882 | 7/1990 | Hayes | 2/19 |
| 4,964,174 | 10/1990 | Murhin | 2/164 |
| 5,020,160 | 6/1991 | Cano | 2/159 |
| 5,031,239 | 7/1991 | Panichello et al. | 2/19 |
| 5,075,899 | 12/1991 | Funahashi et al. | 2/19 |
| 5,113,530 | 5/1992 | Smith | 2/19 |
| 5,155,864 | 10/1992 | Walker et al. | 2/18 |
| 5,155,865 | 10/1992 | Walker et al. | 2/18 |
| 5,155,866 | 10/1992 | Walker et al. | 2/18 |
| 5,253,365 | 10/1993 | Clevenhagen | 2/19 |
| 5,367,707 | 11/1994 | Murai | 2/19 |
| 5,367,712 | 11/1994 | Smith et al. | 2/162 |
| 5,379,460 | 1/1995 | Aoki | 2/19 |

BASEBALL OR SOFTBALL GLOVE HAVING ELASTIC LINER

BACKGROUND OF THE INVENTION

The present invention relates generally to baseball and softball gloves, and more particularly to a glove having improved fit.

It is advantageous for a baseball or softball glove to have a large pocket in order to maximize a player's ability to capture a ball. However, one of the disadvantages of a conventional glove with a large pocket is that a player with a small or medium-sized hand may have difficulty opening and closing the glove. Furthermore, a small or medium-sized hand is likely to encounter some degree of sideways movement within a very large glove, as well as longitudinal movement toward and away from the upper or distal end of the glove.

It would be beneficial to provide a glove which has a relatively large pocket and which can be readily manipulated by the wearer, even if the wearer has a small hand.

SUMMARY OF THE INVENTION

It is an object of the invention to provide a custom-fit ball-catching glove for all hand sizes.

Another object of the invention is to provide a ball-catching glove which has a large pocket and is particularly well suited for use by a player having a small or medium-sized hand.

Yet another object off, the invention is to provide a ball-catching glove in which lateral and longitudinal movement of a player's hand within the glove is reduced.

Yet another object of the invention is to provide a ball-catching glove in which the wearer can more easily open and close the glove.

Other objects will be in part obvious and in part pointed out more in detail hereinafter.

The invention in a preferred form is a ball-catching glove comprising a front portion and a back portion defining a hand space therebetween which includes a major region for receiving the fingers of the wearer and a minor region for receiving the thumb of the wearer. The glove has an opening at an edge for the passage of the hand of the wearer into the hand space. The glove also includes an elastic liner formed in the hand space and connected to the front portion. The elastic liner is configured to draw the wearer's hand toward the front portion. In a particularly preferred form of the invention, the elastic liner is configured to bear against the back of the wearer's hand.

The elastic liner preferably is configured to limit lateral movement of the wearer's hand within the glove relative to the front portion of the glove, and also to limit longitudinal movement of the hand within the glove toward and away from the distal end of the glove. Typically, the elastic liner has a pair of opposite sides, each of which is connected to the front portion of the glove.

In the preferred embodiments of the invention, the elastic liner extends through both the major region and the minor region of the hand space. In an open back glove, the elastic liner is configured to extend across the back of the wearer's hand and to contact at least the back of the wearer's thumb and fifth finger. When configured for use in a fastback glove, the elastic liner preferably not only extends across the back of the wearer's hand and contacts the back of the wearer's thumb and fifth finger, but also contacts the back of the wearer's third and fourth fingers.

In a particularly preferred form of the glove, the elastic liner has a pull strap for drawing the elastic liner along the back of the wearer's hand, thereby enabling the elastic liner to fit smoothly over the wearer's hand and facilitating entry and exit of the wearer's hand without deforming the shape of the elastic liner over time.

Another preferred form of the invention is a method of making a softball glove. The method comprises (1) obtaining a front glove portion and a back glove portion which can be combined to define a hand space therebetween which includes a major region for receiving the fingers of the wearer and a minor region for receiving the thumb of the wearer, and having and opening at the edge of the glove for the passage of the hand of the wearer into the hand space, and (2) fastening an elastic liner to the front glove portion of the glove in a manner appropriate to position the elastic liner within the hand space, the elastic liner being configured to draw the wearer's hand toward the front portion.

The invention accordingly consists in the features of construction, combination of elements and arrangement of parts which will be exemplified in the construction hereafter set forth and the scope of the application which will be indicated in the appended claims.

DETAILED DESCRIPTION OF THE PREFERRED EMBODIMENT

According to the present invention, a glove which is adapted to custom-fit the wearer, allowing for improved control while maintaining a large pocket size, is provided. The shell or outer front and back layers of the glove can be of conventional design. Additional details about the shell and other parts of the glove which are similar to known glove designs can be found in prior issued patents to ball-catching gloves, including U.S. Pat. No. 5,155,866, the contents of which are incorporated herein by reference, U.S. Pat. No. 5,155,864 and U.S. Pat. No. 5,155,865, and others.

Figure 1:
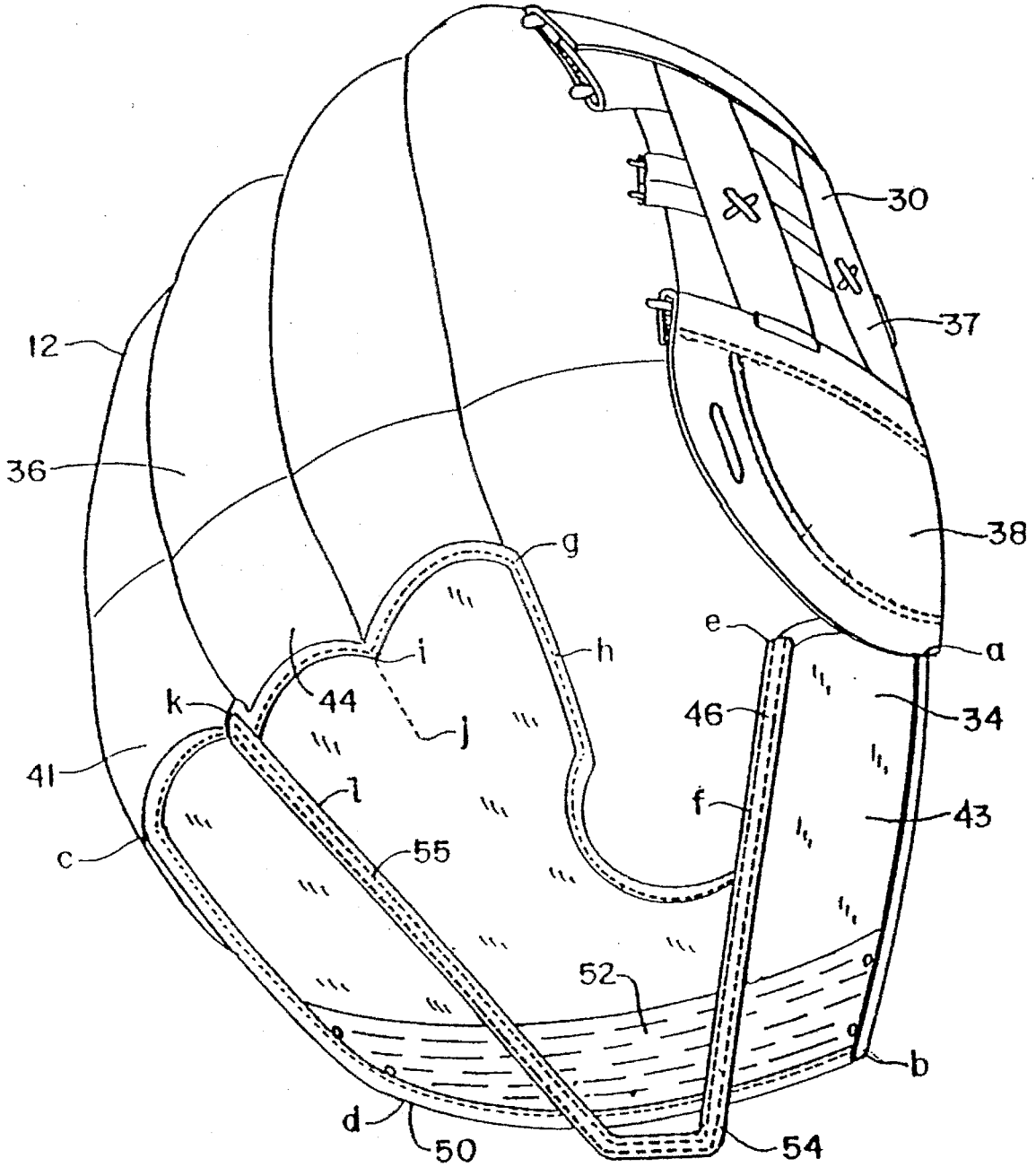
FIG. 1 is a rear elevational view of the front portion of a glove according to a first embodiment of the invention, with the back portion of the glove removed.
Figure 2:
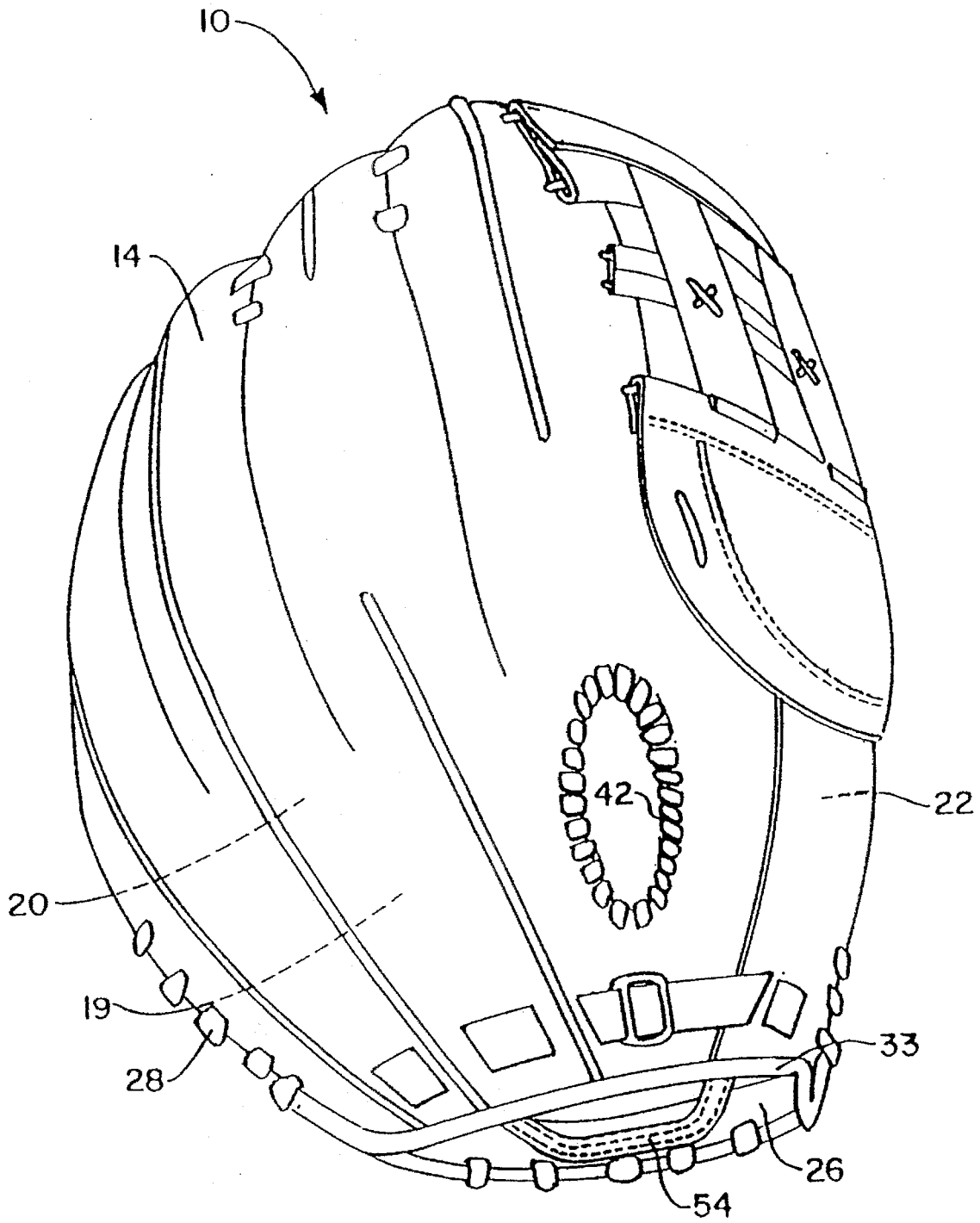
FIG. 2 is a back view of the first embodiment of the glove, fully assembled, showing the back portion of the glove and the pull strap of the liner.
Figure 3:
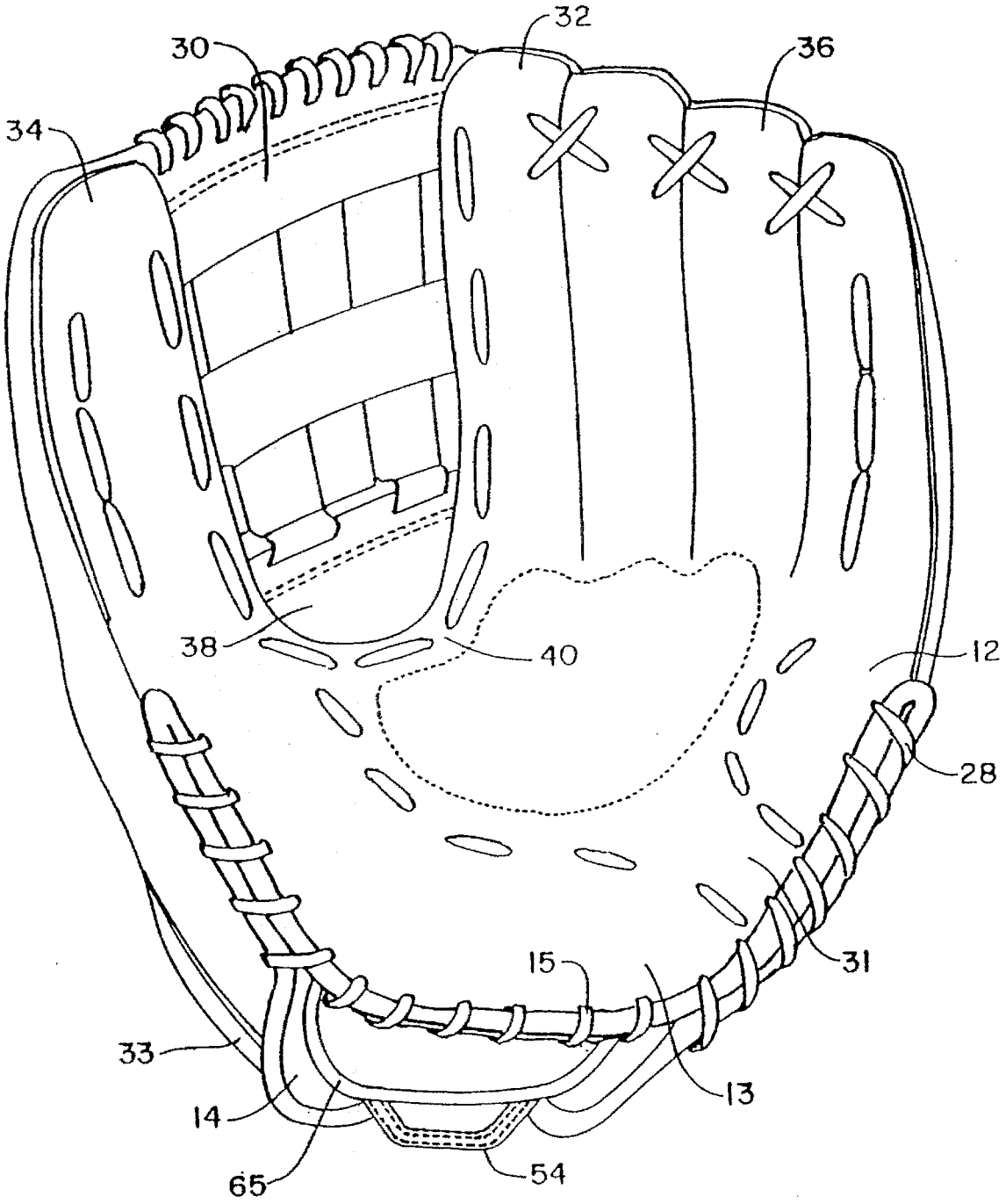
FIG. 3 is a front elevational view of the embodiment of the glove which is shown in FIG. 2.

Referring now the drawings and in particular to FIGS. 1–3, a fastback glove according to the present invention is shown and is designated as 10. The glove has a front portion 12 and a back portion 14 which are made of suitable material, such as leather. The material defines a hand space 19 including a major region 20 for the receipt of the wearer's fingers and a minor region 22 for the receipt of the wearer's thumb. An opening 26 is formed at the lower end 33 of the glove 10 between the front portion 12 and back portion 14 through which the wearer can insert their hand into the hand space 19. Stitching and lacing 28 couple the front portion 12 and back portion 14 to each other. Webbing 30 is positioned between the thumb portion 34 and the finger portion 36. Webbing 30 includes an upper woven portion 37 attached to a semi-oval-shaped well portion 38 both of which, in conjunction with outer surface 31 of the front portion 12, form a pocket 40 for accurately catching a ball.

The back portion 14 of the glove has an oval-shaped aperture 42 through which the wearer can extend their index finger.

The webbing 30 is positioned to enable the wearer to pivot the glove open and closed relative to an axis which extends diagonally from a location between the index finger and thumb of the wearer to the lower end of the wearer's hand.

The front portion 12 of the preferred embodiment has an inner surface 44 which is formed at least in part by the front portion of a palm liner 41. The palm liner 41, which is reduced in size by about 15% as compared to a conventional palm liner, is attached to an outer front layer 13 in a conventional manner by lacing 15 at the bottom of the glove. The top of the front portion of the palm liner and also the back portion of the palm liner are stitched or otherwise fastened to the outer layers or shell of the glove in a conventional manner. In other embodiments of the invention (not shown), the front portion is a single layer and the inner surface 44 and outer surface 31 are opposite surfaces of a single layer.

An elastic liner 43 is affixed to the inner surface 44 of the front portion 12, e.g., by stitching to the palm liner 41, and is adapted to bear against the back of the wearer's hand, thereby drawing the wearer's hand away from back portion 14 and causing the front of the wearer's hand to bear against the inner surface 44 of front portion 12. The liner 43 is configured to overlap approximately the lower half of the front portion 12. The liner 43 has a cut-out portion 46 which corresponds to the aperture 42 in the back portion. The liner 43 is stitched or otherwise fixed to the front portion 12 along both sides of the thumb portion 34, along the side of the index finger portion near the wearer's middle finger, along the side of the finger portion 36 which is near the wearer's middle finger, between the wearer's fourth and fifth fingers, and along the outer edge near the wearer's fifth finger in a manner described below in further detail. The liner 43 is not stitched to the glove 10 at its lower end 33 thereby enabling the wearer to insert their hand between the liner and the inner surface 44 of front portion 12. The liner 43 is sized and is spaced from the inner surface 44 in an amount appropriate to provide for a tight but comfortable stretch-fit around the back of the wearer's hand and fingers.

Preferably, the liner 43 extends up a portion of the back of the wearer's fingers. It is not necessary for the liner 43 to extend up to the top of the wearer's fingers in order for the liner to provide for improved hand control over the control achieved with a conventional glove. Furthermore, there are important advantages to the preferred embodiment in which the elastic liner 43 does not extend up to the tips of the wearer's fingers. First, the liner 43 is better able to accommodate a variety of hand sizes. Second, the open finger design provides added comfort. Third, the open finger design provides for good breathability while offering maximum control in the most important flex area of the hand. Fourth, it is believed that the upper edge of the elastic liner 43 may "grab" the back of the wearer's fingers, thereby providing further stability of the glove on the wearer's hand.

The lower end 50 of the liner 43 is reinforced with a sturdy elastic stretch strap 52 which is positioned to extend transversely across the back of the wearer's hand at or just above the wrist outside the liner 43. This helps to prevent the glove from falling off of the wearer's hand. The strap 52 allows for flexibility of the liner 43 when the glove 10 is placed on the wearer's hand, and provides support for maintaining the glove 10 on the wearer's hand in a generally fixed position after insertion of the hand. The strap 52 is stitched to the liner 43 at each end of the strap, and preferably also is stitched to the liner 43 along the entire length of the strap 52.

It is significant that the strap 52 is located inside the glove because it will then continue to serve as a support when the glove softens. While the stretch strap could be replaced by non-elastic strap which is adjustable using a buckle or the like, it is preferable to form the strap 52 of an elastic material for reasons of economics, as well as to provide for maximum flexibility in opening and closing the glove. It is further note that if a sufficiently strong and wide strap were used, the strap would constitute both the strap 52 and liner 43 of the preferred embodiment. However, the use of the elastic liner 43 in conjunction with strap 52 provides for optimum fit and control of the glove.

The combination of the strap 52 in conjunction with the liner 43 provides for less permanent stretch in the liner, i.e., less loss of resilience of liner 43, after extended use of the glove.

Figure 6:
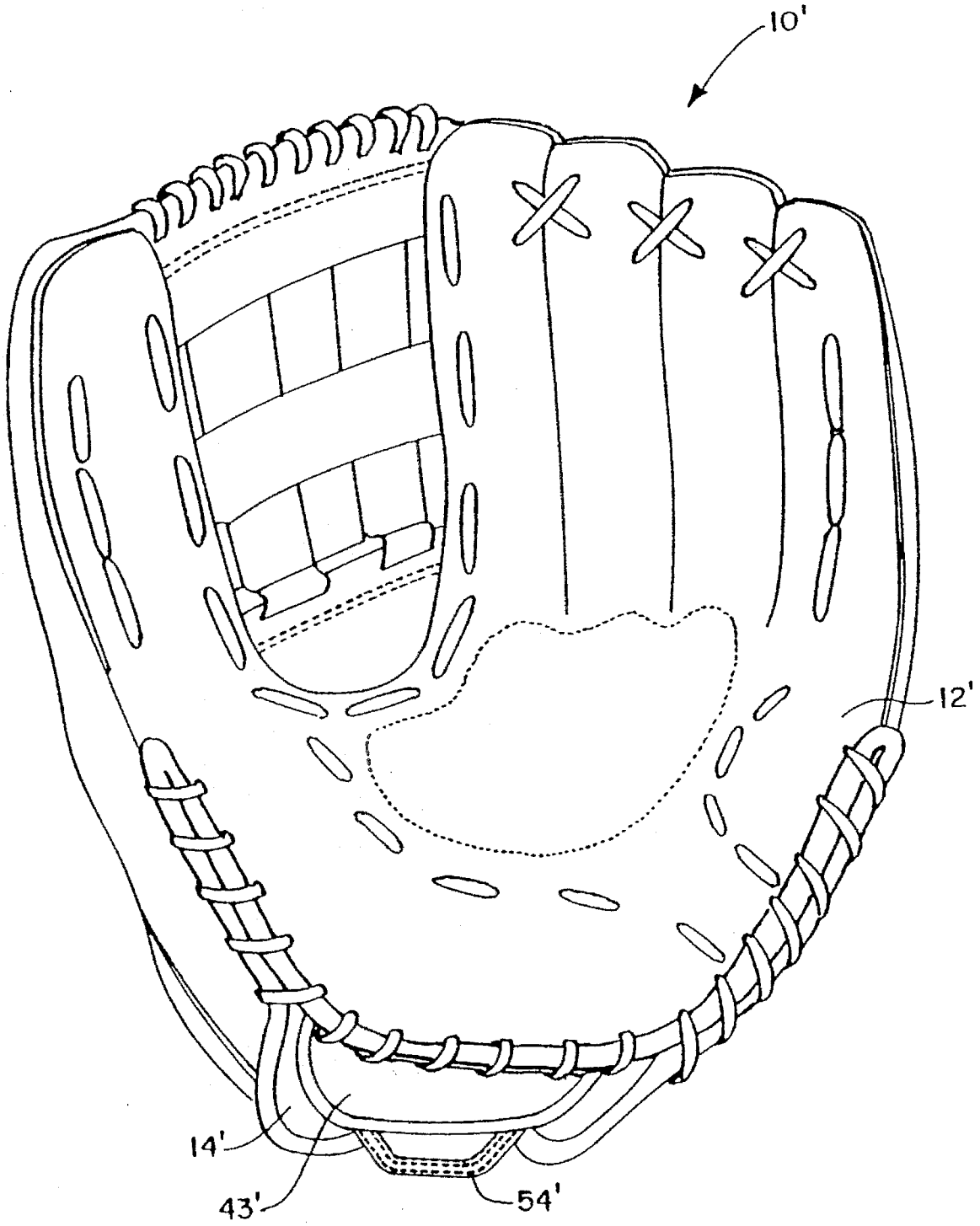
FIG. 6 is a front elevational view of the glove shown in FIG. 5.

To facilitate placement of the glove 10 on the wearer's hand, a pull strap 54 having a loop-type configuration at the lower end of the liner 43 is fastened to the liner 43. The pull strap 54 allows the wearer to pull the elastic liner 43 out away from and then across the back of their hand. As shown in FIG. 6, the pull strap 54 extends slightly below the front portion 12 for convenient access by the wearer. When a player puts on the glove of the invention, the player first pulls the pull strap 54 away from their hand and wrist, in a direction which is generally perpendicular to the plane of the lower part lower part of the front surface of the glove in order to provide a relatively wide opening for the player's hand.

One preferred configuration for mounting the pull strap 54 on the liner 43 is to stitch a generally V-shaped, non-elastic or slightly elastic component 55 from the upper to the lower side of the liner 43. This configuration provides additional reinforcement for the liner in the direction of the length of the glove from top to bottom while, at the same time, providing a pull strap 54 which is formed by positioning the vertex of the V below the lower end of the liner. The vertex of the V preferably is not pointed, but instead is flattened to facilitate gripping by the wearer. As shown in FIG. 1, side-by-side double stitching of the pull strap 54 on the liner 43 provides added reinforcement. The legs of the "V" are angled in a manner appropriate to work in conjunction with the wearer's fingers for proper flexing of the glove and for proper stretch of the liner.

In the embodiment shown in FIGS. 1–3, the stretch liner 43 is stitched to the front portion of the palm liner along the right edge of the thumb portion between points a and b and along the left edge between points c and d in FIG. 1. Furthermore, in order to support the elastic liner 43 within the palm liner when the pull strap 54 is pulled outward in order to insert a hand in the glove, and in order to guide the wearer's fingers within the glove, the liner is stitched to the front portion of the palm liner at various locations in a direction generally parallel to the length of the wearer's fingers. More specifically, the liner 43 is stitched to the palm liner along opposite edges at the distal end of the cutout portion for a distance of about ½"–1" between points e and f and between points g and h near the wearer's index finger and middle finger. Additional stitching is provided in about 1" segments along opposite sides of the wearer's ring finger between points i and j, and between points k and l.

The glove of the present invention preferably is made of leather, and can be made of waterproof leather.

Figure 4:
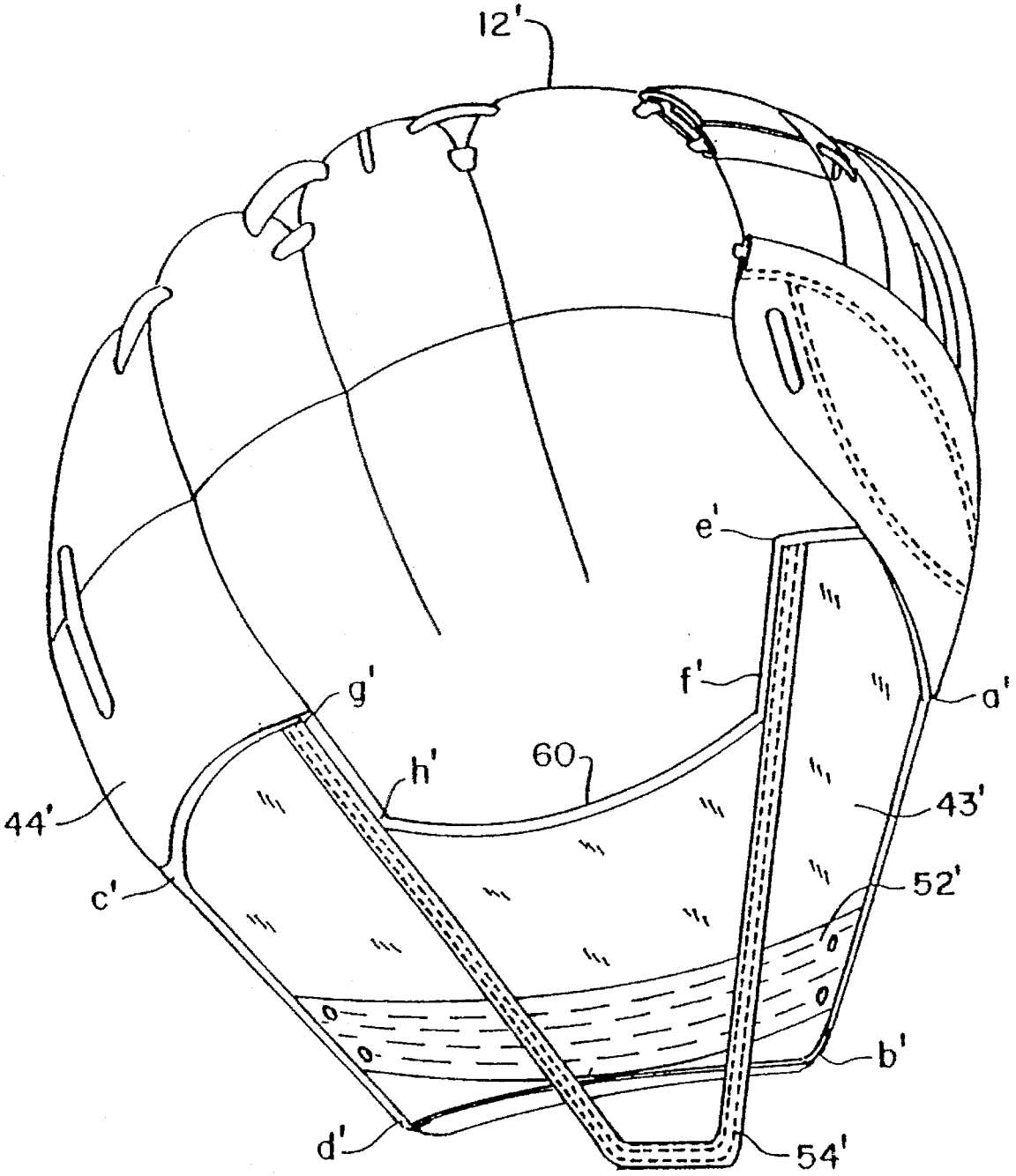
FIG. 4 is a rear elevational view of the front portion of a second embodiment of a glove according to the present invention, with the back portion of the glove removed.
Figure 5:
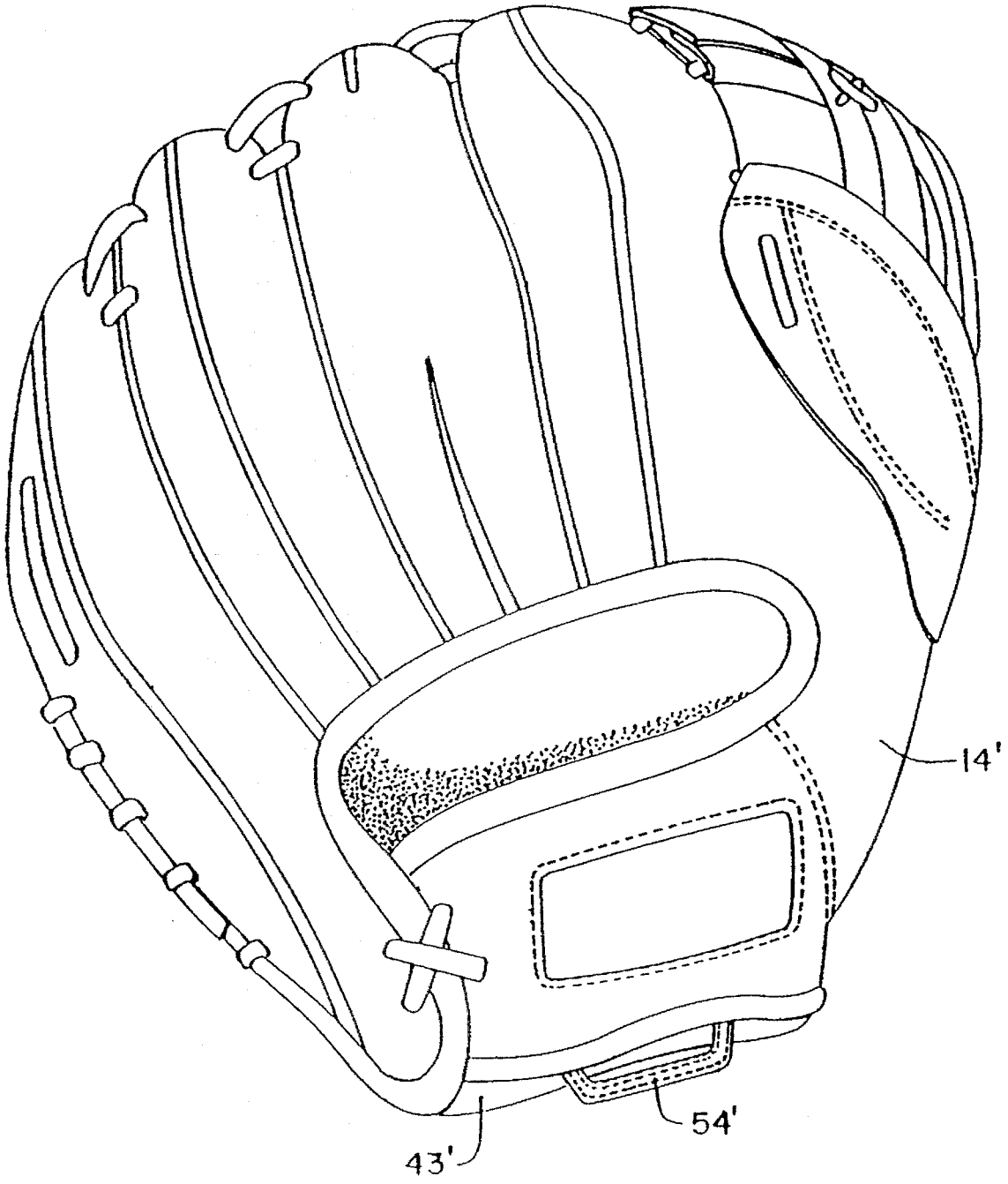
FIG. 5 is a rear elevational view of the second embodiment of the glove, fully assembled, with the back portion attached to the front portion.

A second embodiment of a glove according to the present invention is shown in FIGS. 4–6 and is designated as 10'. This glove, which is of an open back design, includes a front portion 12' with an inner surface 44', and a back portion 14'. A liner 43' is affixed to the inner surface 44' of the front portion 12' along the sides of the glove 10'. The liner 43' overlaps much of the lower half of the front portion, and has a generally D-shaped cut-out 60 corresponding to the open back of the back portion 14'. The liner 43' is stitched to the inner surface 44' of the front portion 12' at locations between the thumb and index finger of the wearer, and between the fourth and fifth fingers of the wearer. In other respects, the design of the liner 43' is generally the same as that of the liner 43' shown in the embodiment depicted in FIGS. 1–3, i.e., the liner 43' has a reinforcing stretch strap 52' along its back, and a pull strap 54' to facilitate placement of the glove on the wearer's hand.

The liner 43' is stitched to the palm liner along the right side of line 3' between points a' and b', and along the left side of liner 43' between points c' and d'. Additional locations at which the liner 43' is stitched to the palm liner are along the inner side of the thumb portion between points e' and f' and along the outer edge of the wearer's ring finger between points k' and l'.

The glove of the present invention is useful for ball players having a variety of hand sizes, and is particularly advantageous for use by those having medium or small-sized hands. In one preferred embodiment of the invention, the glove is configured to fit a small or medium-sized hand while maintaining a pocket size that is generally equivalent to the pocket size of a glove having a palm portion which is configured for a large hand. In the embodiments shown in FIGS. 1–6, the size of the palm liner has been reduced by about 10–20% or more preferably about 15% to provide better fit from small hand sizes, including women's hand sizes. The liner, including the stretch strap, provides for additional control, thereby facilitating opening and closing of the glove. The inclusion of an elastic liner enables comfortable and controlled use of a glove having a large pocket size.

The glove of the present invention is assembled generally in the same manner as a conventional glove with the exception that the liner is stitched to the inner surface of the front portion.

The liner preferably is a single layer and is made of an elastic material which breathes well. Several non-limiting examples of suitable liner material include perforated neoprene foam, lycra and the like. The edge of the liner 43 is reinforced by an elastic binding 65 which helps the liner 43 retain its shape and resilience when the glove is subjected to extensive use. The stretch strap is made of a sturdy elastic material that will withstand extended use in competitive conditions without losing its resiliency. In a particularly preferred form, the stretch strap has a width of about ¼"–3", more preferably ½"–2", and most preferably about 1". In contrast to inflatable bladders which have been used in other glove designs, the liner is not inflatable and is configured for use in a glove which does not have an inflatable bladder to be positioned at the back of the wearer's hand.

As will be apparent to persons skilled in the art, various modifications and adaptations of the structure above described will become readily apparent without departure from the spirit and scope of the invention, the scope of Which is defined in the appended claims.

What is claimed is:

1. A ball-catching glove, comprising:

a front portion and a back portion defining a hand space therebetween which includes a major region for receiving fingers of a wearer and a minor region for receiving a thumb of the wearer, an opening at an edge of the glove which is configured for receiving a hand of the wearer in the hand space, an elastic liner formed in the hand space and connected to the front portion, the liner being configured to draw the wearer's hand toward the front portion, and an elastic strap connected to a portion of the elastic liner for reinforcing said portion, the elastic strap being configured to extend transversely across the back of the wearer's hand proximate the wearer's wrist.

2. A glove according to claim 1, wherein the liner includes means for limiting lateral movement of the wearer's hand relative to the front portion.

3. A glove according to claim 1, wherein the liner includes means for limiting longitudinal movement of the wearer's hand relative to the front portion.

4. A glove according to claim 1, wherein the liner has a pair of opposite lateral sides, each of which is connected to the front portion of the glove.

5. A glove according to claim 1, wherein the liner extends through both the major region and the minor region of the hand space.

6. A glove according to claim 1, wherein the liner is configured to contact the back of the wearer's thumb and fifth finger.

7. A glove according to claim 6, wherein the liner is configured to contact the back of the wearer's third and fourth fingers.

8. A glove according to claim 1, wherein the liner includes a pull strap for pulling the lower end of the liner away from the front portion to facilitate insertion of a hand.

9. A glove according to claim 1, wherein the front portion includes a front palm lining and the elastic liner is connected to the front palm lining.

10. A glove according to claim 9, wherein the glove has a predetermined pocket size and the front palm lining is about 10–20% smaller than a front palm lining of a glove having generally the same pocket size and having a front palm lining which is configured for a large hand.

11. A method of making a ball-catching glove comprising:

obtaining a front glove portion and a back glove portion which can be combined to define a hand space therebetween which includes a major region for receiving fingers of a wearer and a minor region for receiving a thumb of the wearer, and having an opening at the edge of the glove for the passage of a hand of the wearer into the hand space, fastening an elastic liner to the front glove portion in a manner appropriate to position the elastic liner within the hand space, the elastic liner being configured to draw the wearer's hand toward the front portion, and fastening an elastic strap to a portion of the elastic liner to reinforce said portion, the elastic strap being configured to extend transversely across the back of the wearer's hand proximate the wearer's wrist.

12. A method according to claim 11, wherein the liner has a pair of opposite lateral sides, and the step of fastening comprises connecting each of the opposite lateral sides to the front portion of the glove.

13. A method according to claim 11, further comprising the step of forming a pull strap on the liner proximate to the opening in the glove to enable the wearer to pull the liner along the back of their hand.

14. A glove according to claim 1, wherein the elastic strap is configured to prevent the glove from falling off of the wearer's hand.

15. A glove according to claim 1, wherein the elastic strap has a width of about ½–2 inches.

16. A glove according to claim 8, wherein the elastic strap has a width of about ½–2 inches.

17. A method according to claim 11, wherein the elastic strap is fastened such that the elastic strap will prevent the glove from falling off of the wearer's hand.

18. A method according to claim 11, wherein the elastic strap has a width of about ½ to 2 inches.

19. A method according to claim 13, wherein the elastic strap has a width of about ½ to 2 inches.

* * * * *